US008240426B2

(12) United States Patent
Silver et al.

(10) Patent No.: US 8,240,426 B2
(45) Date of Patent: Aug. 14, 2012

(54) THREE DIMENSIONAL ACOUSTIC PASSIVE RADIATING

(75) Inventors: Jason D. Silver, Framingham, MA (US); Roman N. Litovsky, Newton, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 12/859,396

(22) Filed: Aug. 19, 2010

(65) Prior Publication Data

US 2012/0043157 A1 Feb. 23, 2012

(51) Int. Cl.
*G10K 13/00* (2006.01)

(52) U.S. Cl. ..... 181/173; 181/153; 381/430

(58) Field of Classification Search ..... 181/153, 181/173; 381/423, 430
See application file for complete search history.

(56) References Cited

U.S. PATENT DOCUMENTS

| | | | | |
|---|---|---|---|---|
| 1,690,726 | A * | 11/1928 | Holinger | 455/350 |
| 1,988,250 | A | 1/1935 | Olson | |
| 4,076,097 | A * | 2/1978 | Clarke | 181/147 |
| 4,139,733 | A * | 2/1979 | Falkenberg | 381/96 |
| 4,473,721 | A * | 9/1984 | Klein | 381/190 |
| 4,488,010 | A * | 12/1984 | Klein et al. | 381/190 |
| 4,673,057 | A | 6/1987 | Glassco | |
| 5,432,860 | A | 7/1995 | Kasajima et al. | |
| 5,694,374 | A | 12/1997 | Ripoll et al. | |
| 5,875,154 | A | 2/1999 | Dechico | |
| 6,356,642 | B1 | 3/2002 | Nakamura et al. | |
| 6,658,129 | B2 * | 12/2003 | D'Hoogh | 381/349 |
| 7,624,839 | B1 * | 12/2009 | Graber | 181/156 |
| 2006/0196723 | A1 | 9/2006 | White | |
| 2008/0008346 | A1 | 1/2008 | Setiabudi et al. | |

FOREIGN PATENT DOCUMENTS

| | | | |
|---|---|---|---|
| DE | 2709374 | A1 | 9/1978 |
| EP | 0075911 | A1 | 4/1983 |
| JP | 2005094535 | A * | 4/2005 |

OTHER PUBLICATIONS

International Search Report and Written Opinion dated Dec. 14, 2011 for International Patent Application No. PCT/US2011/048065.

* cited by examiner

*Primary Examiner* — Jeremy Luks
(74) *Attorney, Agent, or Firm* — Bose Corporation

(57) ABSTRACT

A three dimensional acoustic passive radiator diaphragm. A diaphragm a three dimensional volume. An acoustic driver radiates pressure waves into the three dimensional volume to cause the diaphragm to expand and contract. The three dimensional passive radiator may include a core of a porous, compressible material.

19 Claims, 6 Drawing Sheets

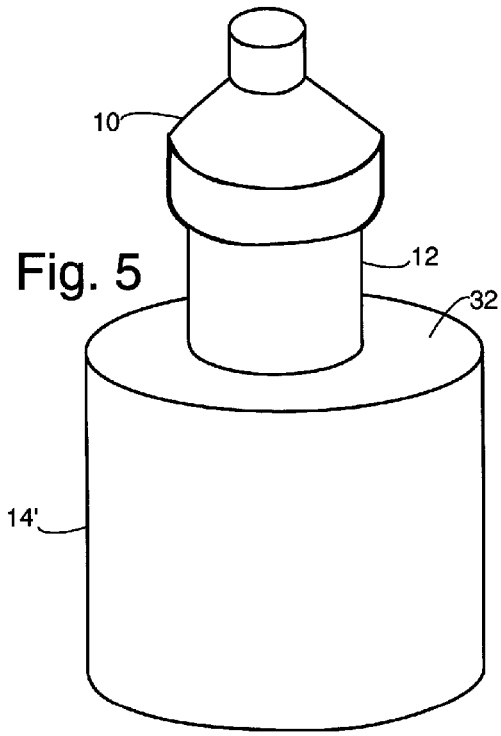
Fig. 5
Fig. 6A
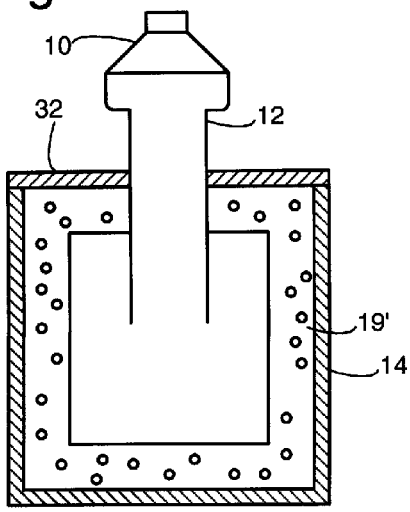
Fig. 6B
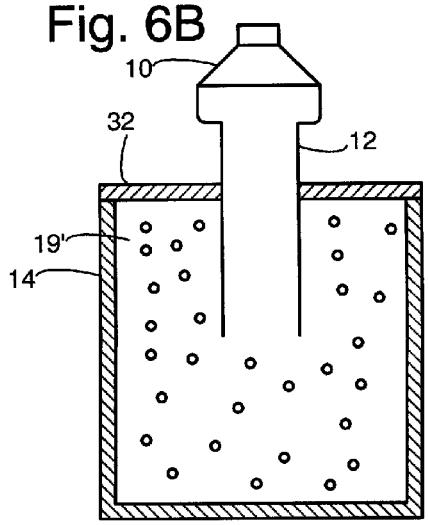

THREE DIMENSIONAL ACOUSTIC PASSIVE RADIATING

BACKGROUND

This specification describes an acoustic device including a passive radiator. Passive radiators are described in U.S. Pat. No. 1,988,250, "Loud Speaker and Method of Propagating Sound" issued Jan. 15, 1935 to H. F. Olson.

SUMMARY

In one aspect acoustic device includes a passive radiator diaphragm having an interior and an exterior and substantially enclosing a three dimensional volume and an acoustic driver radiating pressure waves into the three dimensional volume to cause the diaphragm to expand and contract. The acoustic device of claim may further include a core of a porous, compressible material. The core may be solid. The core may be hollow. The exterior of the core may be adhered to the interior surface of the diaphragm. The acoustic core may be open cell foam. The core may be prestressed. The passive radiator diaphragm may include silicone. The passive radiator diaphragm may include particles of a dense material that increase the mass of the passive radiator diaphragm. The three dimensional volume may be a sphere. The three dimensional volume may be a cylinder. The acoustic device may further include a first duct pneumatically coupling a radiating surface of the acoustic driver and the interior of the passive radiator diaphragm. The acoustic device may further include a second duct coupling the acoustic driver or a second acoustic driver and the interior of the passive radiator diaphragm. The duct may be pneumatically sealed to the passive radiator diaphragm at two locations. A sealed end of the duct may be adhered to the interior of the passive radiator diaphragm. The acoustic driver may be mounted to the passive radiator diaphragm. The passive radiator may include a three dimensional figure may include plurality of polygon shaped panels joined at edges of the polygon shaped panels. The panels may be rigid. The diaphragm may include a flexible material stretched over a wire frame.

In another aspect, a method of making an acoustic device includes: molding a three dimensional hollow passive radiator diaphragm having an interior surface and an exterior surface a passageway coupling the interior and the exterior and the exterior of the passive radiator diaphragm; inserting a duct through the passageway; and inserting a core into the diaphragm through the duct. The inserting the core may include inserting a core that has a volume larger than volume of the duct prior to the inserting. The inserting the core may include inserting a core that has a dimension larger than the interior of the passive radiator diaphragm.

Other features, objects, and advantages will become apparent from the following detailed description, when read in connection with the following drawing, in which:

BRIEF DESCRIPTION OF THE SEVERAL VIEWS OF THE DRAWING

FIG. 5 is a diagrammatic isometric view of an audio device including a cylinder shaped three dimensional passive radiator;

FIGS. 6A and 6B are diagrammatic cross sectional views of variations of the audio device of FIG. 5;

DETAILED DESCRIPTION

A passive radiator includes a diaphragm that vibrates in response to pressure changes resulting from the operation of an acoustic driver. In some applications, a passive radiator diaphragm is mounted in an opening in an acoustic enclosure. The operation of an acoustic driver also mounted in another opening in the enclosure causes pressure changes in the enclosure. The pressure changes cause the passive radiator diaphragm to vibrate, which causes acoustic energy to be radiated by the passive radiator.

Figure 1A:
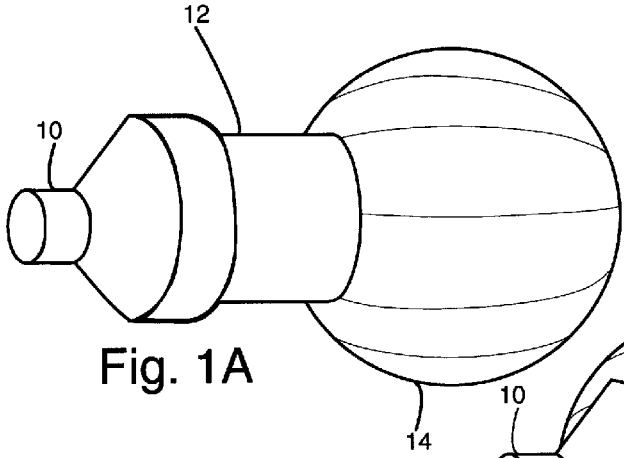
FIGS. 1A and 1B are diagrammatic isometric views of an audio device including a three dimensional passive radiator.
Figure 1B:
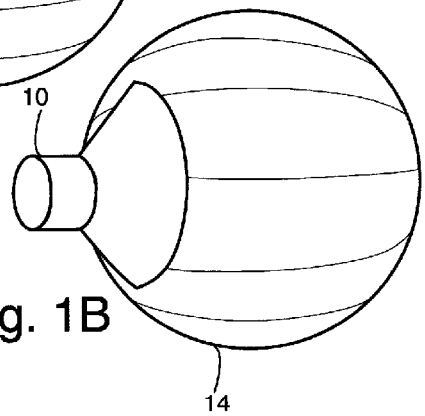
Figure 2A:
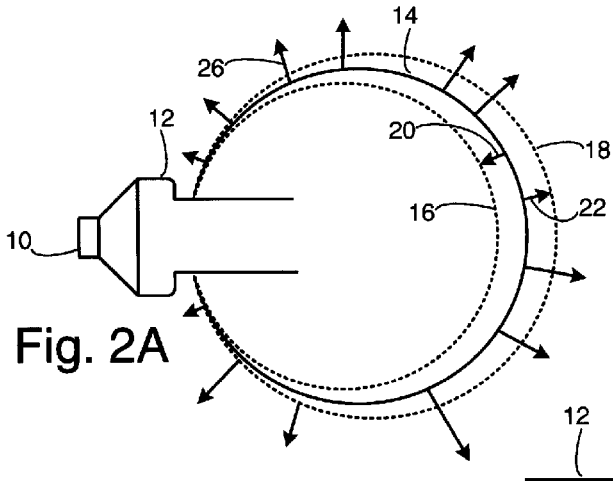
FIG. 2A is a diagrammatic cross sectional view of the audio device of FIG. 1A.
Figure 2B:
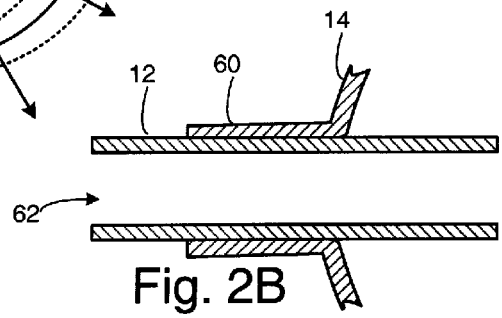
FIG. 2B is a diagrammatic cross sectional view of a portion of the audio device of FIG. 2A.

FIG. 1A is a diagrammatic view of an acoustic device including a passive radiator. A passive radiator diaphragm 14 encloses a three dimensional space and has an interior surface and an exterior surface and a passageway through which pressure waves can be transmitted to the interior of the diaphragm. The passageway may be a hole in the passive radiator diaphragm, or may be a sleeve, as shown in FIG. 2B below. An example of a three dimensional space that may be enclosed by diaphragm 14 is a sphere. Many of the following examples will use a spherical diaphragm; however the acoustic device described can be implemented with many different geometric figures, some of which will be described below. A duct 12 is inserted through the passageway and may extend some distance into the three dimensional figure. An acoustic driver 10 is coupled to the duct so that pressure waves radiated by a radiating surface of the acoustic driver are transmitted to the interior of the passive radiator diaphragm. The housing of the acoustic driver 10 and the pressure transmission duct 12 are rigid and fixed. Diaphragm 14 is of made of a flexible material so that the sphere can expand and contract in response to acoustic pressure waves radiated by the acoustic driver 10, as indicated in FIG. 2A by dotted lines 16 and 18 and by arrows 20 and 22. The expansion and contraction compresses and rarefies the air surrounding the sphere, generating acoustic energy. The acoustic energy is radiated by substantially the entire diaphragm 14 and in all directions as indicated by arrows such as arrow 26. Points on the diaphragm, except points that are constrained, for example, points that are constrained by attachment to the pressure transmission duct, move inwardly and outwardly together, so the motion of all moving points is in phase. As the diaphragm expands and contracts, the volume enclosed by the diaphragm increases and decreases. FIG. 1B shows an alternate configuration in which the acoustic driver 10 is mounted to the diaphragm and radiates pressure waves directly into the diaphragm 14. The operation is similar to the configuration of FIG. 1A. FIGS. 1A and 1B are diagrammatic and do not show all the components that would be present in an actual implementation. For example, in an actual implementation of FIG. 1B, the diaphragm could have a rigid flange that is either adhered to the diaphragm or overmolded on the diaphragm. The flange and the basket of the acoustic driver could both be mounted on a frame. In addition, in the implementation of FIG. 1B, the acoustic driver could be mounted with the motor structure inside the sphere.

One embodiment of the pressure transmission duct 12 and the diaphragm 14 is shown in FIG. 2B. A sleeve 60 which may be made of the same material as the diaphragm 14, defines a passageway 62 from the exterior of the diaphragm to the interior of the diaphragm. The inside diameter of the passageway is slightly smaller than the exterior dimension of the duct 12. When the duct is inserted into the passageway, the passageway expands slightly, forming a pneumatic seal so the interior and the exterior of the diaphragm are pneumatically decoupled, except through duct 12.

Figure 3A:
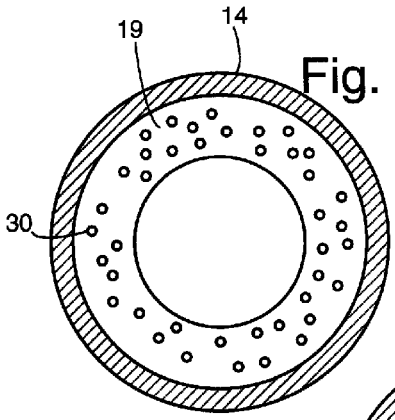
FIGS. 3A-3C are diagrammatic cross sectional views of three dimensional passive radiator diaphragms.
Figure 3B:
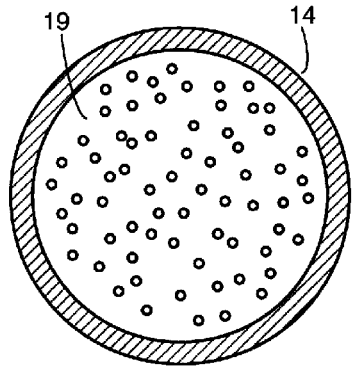
Figure 3C:
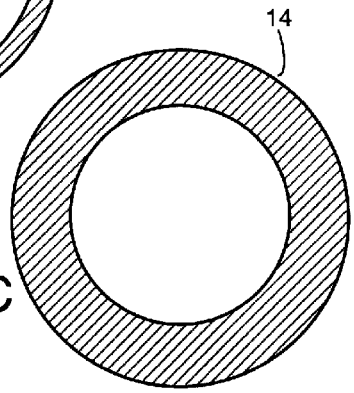

FIGS. 3A-3C are diagrammatic cross-sections of diaphragm 14. The diaphragm is a highly flexible, acoustically opaque material, greatly exaggerated in thickness in this view. Inside the diaphragm 14 may be a core 19 of very soft foam. The core may be hollow as in FIG. 3A or solid as in FIG. 3B. The small circles such as circle 30 indicate that the material is foam. The circles are for the purpose of indicating foam only, and do not necessarily represent the structure of the foam or any characteristics of the foam. The outer surface of the core 19 may be adhered to the inner surface of the diaphragm 14. The diaphragm of FIG. 3C has no core 19. Instead, the walls of the diaphragm are thicker to prevent collapsing of the diaphragm.

The material of the diaphragm 14 is desirably very compliant so that the diaphragm spring stiffness does not dominate over the stiffness of the air enclosed by diaphragm 14 in determining the tuning of the passive radiator. The core 19 should be highly porous so that there is as little drop in air pressure between the inside of the core 19 and the inner surface of the diaphragm 14. Open cell foam is more suitable than closed cell foam for the acoustic device of FIGS. 3A and 3B. Some damping in the core and the diaphragm may be desirable to prevent excitation of unwanted modes and to damp unwanted resonances.

In operation, the core 19 provides a foundation to the diaphragm 14 so that when the diaphragm 14 contracts, the diaphragm is less likely to buckle. The effectiveness of the core 19 in reducing buckling can be increased by pre-tensioning the diaphragm 14 as will be described below. If the core is omitted, as in FIG. 3C, buckling may be alleviated by increasing the damping characteristics of the material from which the diaphragm is made.

An important characteristic in determining the appropriate material for the diaphragm is the elasticity of the material. The material should be elastic enough that the tuning frequency of the passive radiator is determined by the stiffness of the air, not the stiffness of the diaphragm, as will be described below. If the material is too elastic, it may droop or deform in usage, and may require a supporting structure such as the foam core of FIGS. 3A and 3B, or support at more than one point, for example as shown below in FIGS. 7A and 7B. One material that is available in a wide variety of elasticities and that has other desirable characteristics is silicone, available, for example from Wacker Silicones Corp. of Adrian, Mich. or Shin-Etsu Silicones of America of Akron, Ohio. Silicones are typically characterized by durometer (hardness) rather than elasticity, so determining an appropriate silicone may require obtaining silicones of a variety of durometers and determining the elasticity empirically.

In one implementation, diaphragm 14 is made of Ecoflex® OO-10 supersoft silicone, 6 mm thick formed into a solid sphere with an outer diameter of 75 mm. Ecoflex® OO-10 supersoft silicone is marketed by Smooth-On Inc. of Easton, Pa., USA. The silicone may be softened (to make the diaphragm softer or to increase the damping, or both) by the addition of SLACKER® tactile mutator marketed by Smooth-On Inc. of Easton, Pa., USA when the silicone is in uncured form. The core 19 is a solid sphere of porous, soft foam, such as polyurethane foam, adhered to the diaphragm 14 with additional elastomer material. The duct 12 is a polycarbonate tube 15 mm in diameter. The acoustic driver 10 is a conventional 50 mm cone type acoustic driver. Implementations having no core, as in FIG. 3C may be about 12 mm in thickness.

Passive radiators are typically tuned to radiate acoustic energy at a resonant frequency, according to $$f = \frac{1}{2\pi} S \sqrt{\frac{\rho c^2}{MV}}$$

Figure 4:
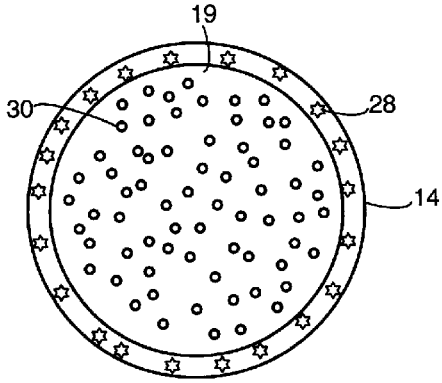
FIG. 4 is a diagrammatic cross sectional view of a three dimensional passive radiator diaphragm with particle of a dense material embedded in the diaphragm.

(where f is the resonant frequency, S is the surface area of the passive radiator, ρ is the density of air, c is the speed of sound, M is the mass of the passive radiator, and V is the volume of the cavity enclosed by the passive radiator) if the stiffness of the passive radiator is dominated by the stiffness of the air. Therefore, the stiffness of the material of the diaphragm 14 should be less than, preferably less than one-third of, the stiffness of the air inside the diaphragm. If the material of the diaphragm is silicone, one technique for decreasing the stiffness of the silicone is to add a softening agent, such as SLACKER® tactile mutator, as mentioned above The resonant frequency is inversely proportional to the square root of the moving mass. Since the diaphragm 14 is thin and typically light, it may be necessary to add mass to the diaphragm 14 to achieve a desired tuning frequency; however the adding of mass should not cause the stiffness of the diaphragm 14 to be more than a fraction, for example ⅓, of the stiffness of the air. One method of increasing the mass of the diaphragm is to add particles of a dense material, such as tungsten, to the silicone in its uncured form, so that the particles are encased by the silicone in its cured form, as indicated by particles such as particle 28 of FIG. 4.

An acoustic device according to the previous figures is advantageous over acoustic devices including other forms of passive radiator diaphragms. Conventional passive radiator diaphragms are planar or cone shaped and have small radiating surfaces relative to the total surface area of the loudspeaker, thus requiring large excursions to radiate significant amounts of acoustic energy, particularly at low frequencies. Large excursions result in material failure, excursion nonlinearities, and unbalanced passive radiator induced enclosure vibrations. Large excursion also requires a complex suspension system which may have non-linear behavior depending on the direction the diaphragm is moving. A passive radiator diaphragm as described above has a very large radiating surface (four times the radiating surface of a disc shaped passive radiator with an equivalent radius) and therefore requires significantly less excursion to radiate the same amount of acoustic energy. Problems associated with non-pistonic behavior, such as rocking modes do not occur. A passive radiator according to the previous figures does not require a suspension in addition to the suspension that is inherent in the device. A suspension may be includes as an enhancement that will be described below in the discussion of FIG. 8. Unlike conventional passive radiators in which the mass of the diaphragm moves in one direction only (which may cause, for example vibration of the entire loudspeaker structure), the mass of the passive radiator according to previous figures is inherently substantially force and mass balanced.

In the implementation of FIG. 5, the diaphragm is in the shape of hollow cylinder 14' and the pressure transmission duct 12 enters the cylinder through one of the ends 32 of the cylinder. Alternatively, the acoustic driver 10 could be mounted directly to an end of the cylinder. As shown in FIGS. 6A and 6B, similar to the embodiments in which the three dimensional figure is a sphere, there may be a core 19' of soft foam, which may be hollow, as shown in the cross section in FIG. 6A or solid, as shown the cross section in FIG. 6B. One or both the ends of the cylinder, such as the end 32 through which the pressure transmission duct 12 enters the cylinder, may be of a different material than the rest of the three dimensional figure, for example a rigid material rigidly coupled to the duct 12 to help the three dimensional figure hold its shape or to provide an attachment point for the pressure transmission duct 12. Rigid structures that are rigidly coupled to the duct may be stationary and not a part of the diaphragm 14 and so that acoustic energy is radiated from the sides (and therefore the sides bulge and contract), and not from the ends. The implementation of FIG. 5 may also be implemented without the duct 12, in a manner similar to FIG. 1B. Implementations using cylinders as the three dimensional object are advantageous because they permit the use of different form factors, such as tall, thin shapes.

Figure 7A:
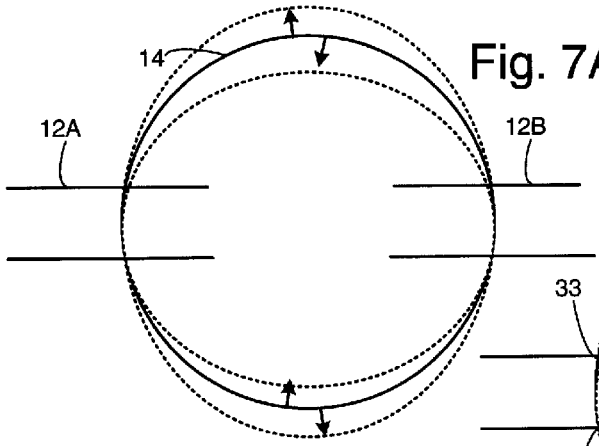
FIGS. 7A-7C are diagrammatic cross sectional views of acoustic devices with three dimensional passive radiators with variations of pressure transmission ducts.
Figure 7B:
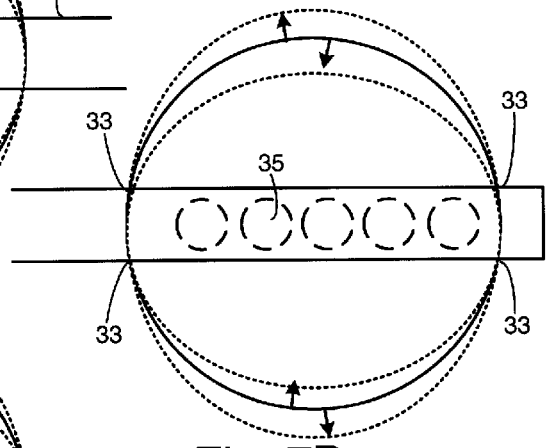
Figure 7C:
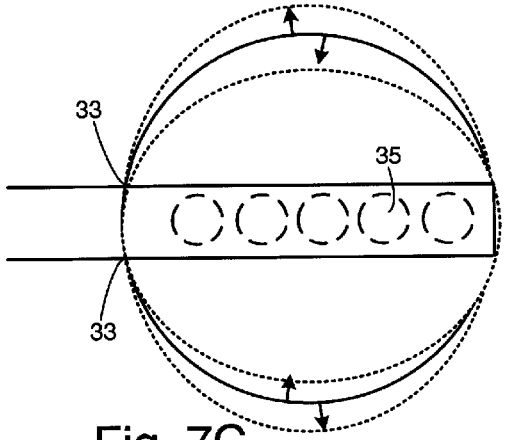

FIGS. 7A-7C illustrate a variation of the acoustic device of previous figures. In the embodiments of FIG. 7A, there are two pressure transmission ducts 12A and 12B entering the diaphragm 14. The pressure transmission ducts may conduct pressure waves from the same acoustic driver or from separate acoustic drivers, preferably driven in phase. In the embodiments of FIGS. 7B and 7C, one end of the pressure transmission duct 12 is closed, and the pressure transmission duct 12 is sealed to the diaphragm 14 at two locations on opposite sides of the diaphragm, either by sealing the sphere to the pressure transmission duct at both sealing points 33 in the same manner, as shown in FIG. 7B, or by adhering the closed end of the pressure transmission duct to the inside of the diaphragm, as shown in FIG. 7C. In the implementations of FIGS. 7B and 7C, there may be openings, such as opening 35, in the duct for the pressure waves to leave the duct 14. The implementations of FIGS. 7A-7C are useful in situations in which it is desirable to have balanced boundary conditions (since the sealing points move less than other points on the three dimensional surface) to avoid exciting undesirable spherical modes.

Figure 8:
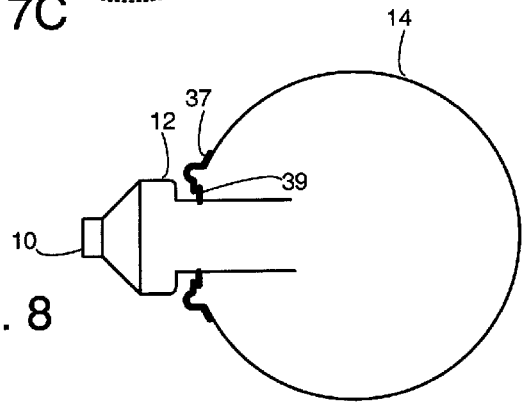
FIG. 8 is a diagrammatic cross sectional view of an acoustic device with a three dimensional passive radiator with a suspension element attaching the passive radiator diaphragm to a transmission duct.

FIG. 8 shows another implementation of an acoustic device that also lessens the excitation of undesirable spherical modes. In the embodiment of FIG. 8, the diaphragm 14 is sealed mechanically and pneumatically and coupled to the pressure transmission duct 12 by a suspension element 37. The suspension element 37 may attach to the pressure transmission duct 12 by a flange 39 on the pressure transmission duct 12. The implementation of FIG. 8 permits the boundary condition—the attachment of the flexible diaphragm to the stationary pressure transmission duct—to be less constraining and less likely to excite the undesirable spherical modes and also permit more of the surface area on the diaphragm to radiate acoustic energy than other implementations.

Figures 9A, 9B:
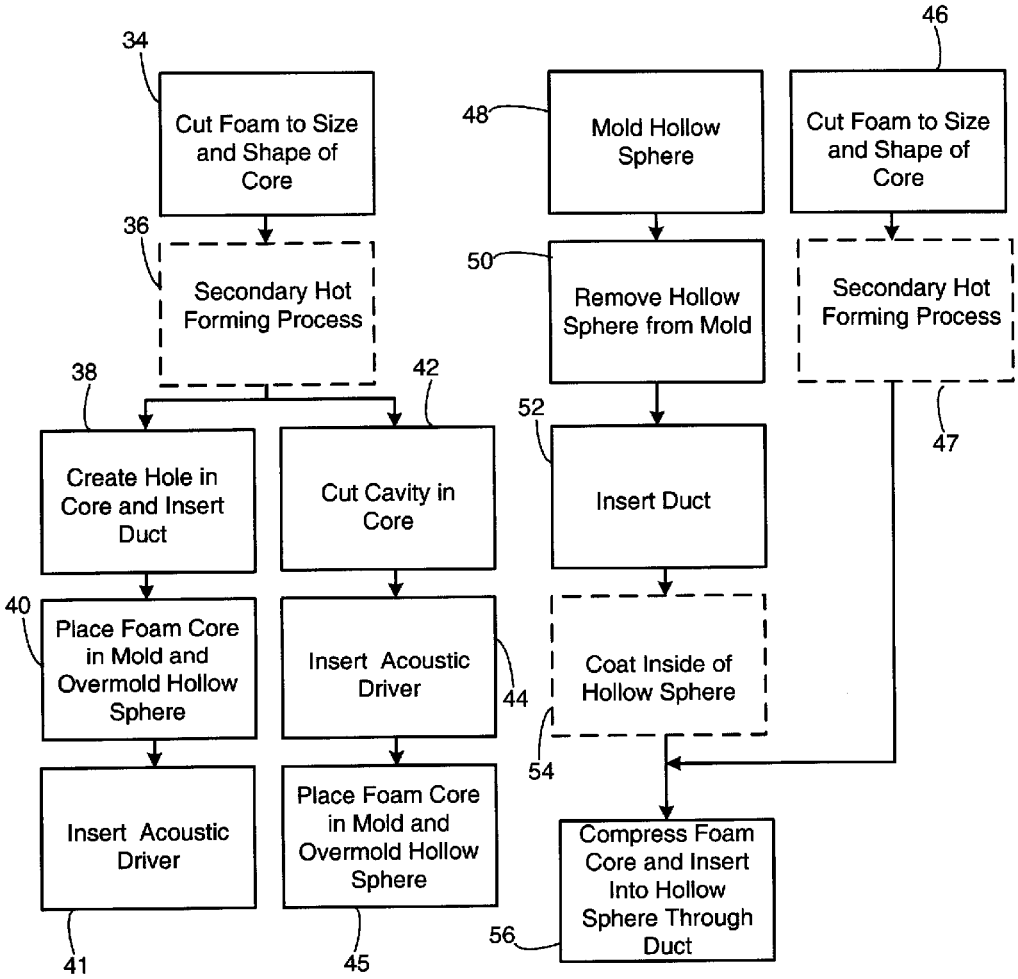
FIGS. 9A and 9B are block diagrams of processes for making an acoustic device with a three dimensional passive radiator.

FIGS. 9A and 9B show processes for making the acoustic device of previous figures. In the blocks of FIGS. 9A and 9B, the activities that are performed in each block may be performed by one component or by a plurality of components, and may be separated in time. One element may perform the activities of more than one block. The elements that perform the activities of a block may be physically separated.

Referring to FIG. 9A, at block 34, the foam is cut and formed to the shape of the core. If complex or more precise geometry is desired, at block 36, the foam core may be processed by a secondary hot forming process in which the foam core is place in a heated mold. In implementations using the pressure transmission duct 12, at block 38 a hole is cut in the core 19 and the duct is inserted in the hole, and at block 40, the foam core is placed in a mold and the diaphragm is overmolded onto the foam core. In the overmolding process, the foam core may be supported, and other measures may be taken to ensure that the foam core does not deform or move. At block 41 the acoustic driver 10 is inserted into the end of the pressure transmission duct 12. In implementations such as FIG. 1B, in which the acoustic driver radiates directly into the diaphragm and not through a duct, following the activities of block 34 or 36, if it is desired to mount the acoustic driver with the motor structure inside the sphere, at block 42 a cavity for the acoustic driver is cut or formed in the core. Following block 42, at block 44, the acoustic driver is placed in position in the cavity formed at step 42, and at step 45, foam core is placed in the mold and the three dimensional figure is overmolded onto the core.

In the process of FIG. 9B, at block 46, the foam is cut to the size and shape of the core, and may be further shaped and formed by a secondary hot forming process at optional block 47. The activities of blocks 46 an 47 can be performed before or concurrently with the activities described below. At block 48, the diaphragm 14 is molded on a mold that has portions forming both the inside and outside surfaces of the mold. In this block, the opening to the sphere and the sleeve 60 may also be formed. At block 50, the diaphragm is removed from the mold. The opening may be smaller than the portion of the mold that forms the inside surface of the mold, but the diaphragm 14 can stretch enough that the diaphragm can be removed. At block 52, the duct 12 is inserted into the core. At optional block 54, the inside of the diaphragm may be coated with an adhesive substance, such as uncured silicone. At block 56, the foam core is compressed and inserted into the diaphragm through the duct, where it expands to its original dimensions. Typically, the foam core is sufficiently compressible that it can fit through the duct even if the diameter of the duct is smaller than the diameter of the core.

The process of FIG. 9B permits the diaphragm to be pre-tensioned, so that the diaphragm in less likely to buckle during contraction. To pre-tension the diaphragm, the core may be made slightly larger than the interior dimension of the diaphragm. When the foam core is compressed, inserted through the duct, and expands to its original dimensions, the foam will exert a tensioning force against the interior of the diaphragm, thereby pre-tensioning the diaphragm.

Figure 10:
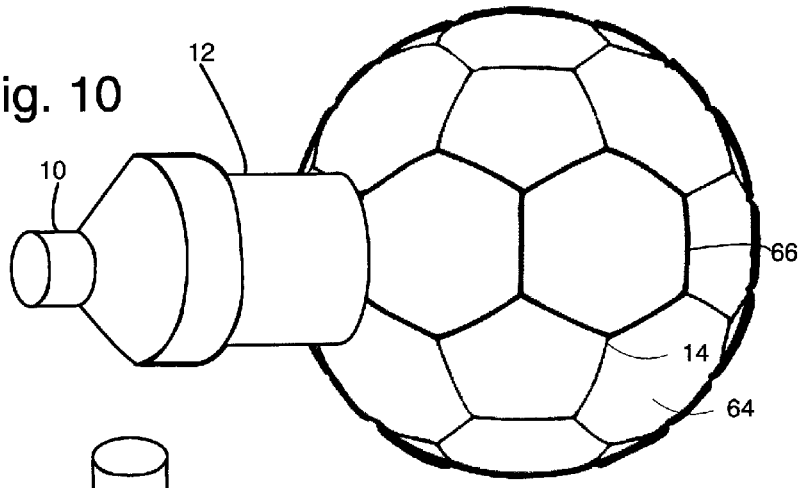
FIG. 10 is a diagrammatic cross sectional view of an alternate configuration of an audio device with a three dimensional passive radiator.

FIG. 10 shows an alternate embodiments of the acoustic device of previous figures. The diaphragm of FIG. 10 is substantially a sphere, with an outside surface that includes a number of polygon shaped panels, such as 64, joined at seams such as seam 66. The embodiment of FIG. 10 can be implemented in a number of ways. The panels 64 may be rigid and planar or rigid and curved. The seams 66 may include a compliant material that permits the sphere to expand and contract. The panels 64 may be compliant material, such as the material of previous figures. With compliant panels, the embodiment of FIG. 10 could be implemented with a rigid "wire frame" in the form of a geodesic sphere, with the diaphragm adhered to the wire frame or stretched over the wire frame and held in place by tension, or both. With compliant panels, the seams could be of the same material as the panels, but with a different thickness so that the seams buckle or stretch to allow the diaphragm to expand and contract. The seams could be implemented in a manner similar to "surrounds" that are used in loudspeakers to attach a diaphragm to a support structure. The embodiment of FIG. 10 may include the core 19 of previous figures to prevent buckling or to restrict the buckling to compliant seams. The embodiment of FIG. 10 may be implemented without the duct 12, and with the acoustic driver 10 mounted directly to the diaphragm or embedded in the diaphragm, as shown in FIG. 1B.

Figure 11:
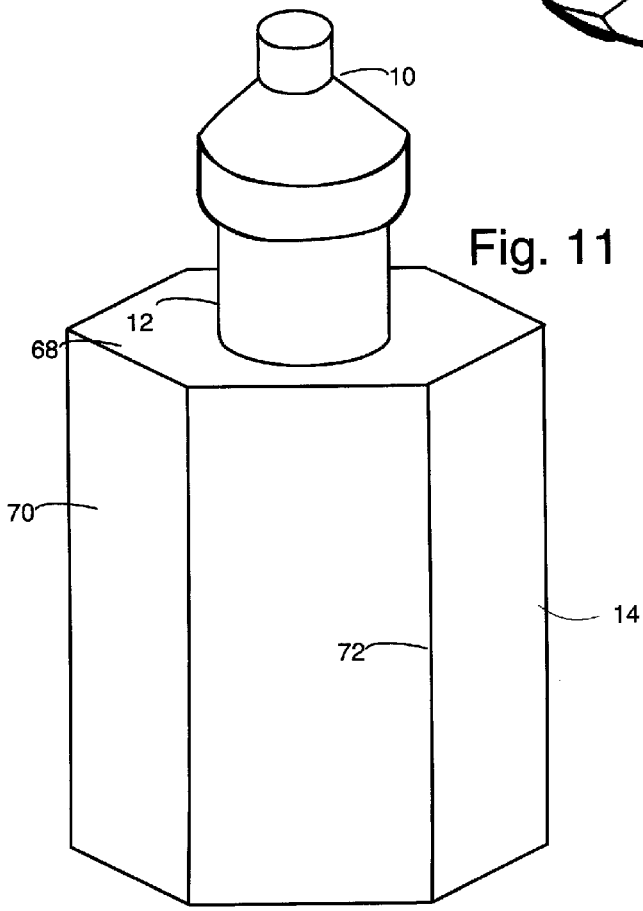
FIG. 11 is a diagrammatic cross sectional view of an alternate configuration of an audio device with a three dimensional passive radiator.

FIG. 11 shows another alternate embodiment of the diaphragm. The diaphragm may be in the shape of a right prism, with ends 68 that have a polygon shape and are planar and parallel and panels 70 that are substantially rectangular. Similarly to the embodiment of FIG. 10, the panels 70 may be rigid and curved or rigid and planar. The interfaces 72 may be compliant to permit the prism to expand and contract. Alternatively, the embodiment of FIG. 11 could be implemented with a rigid "wire frame" in the form of the right prism, and the diaphragm adhered to the wire frame or stretched over the wire frame and held in place by tension, or both. Similarly to the cylindrical embodiment of FIG. 5, the ends 68 may be rigid and stationary and not a part of the diaphragm so that acoustic energy is radiated from the sides and not from the ends. An embodiment of FIG. 11 may include the core 19 of previous figures to prevent buckling or the restrict the buckling to compliant seams. The embodiment of FIG. 11 may be implemented without the duct 12, and with the acoustic driver 10 mounted directly to the diaphragm or embedded in the diaphragm, as shown in FIG. 1B.

One advantage of the passive radiator of the previous figures is that the passive radiator diaphragm can be formed to many different shapes by forming or cutting a core 19 to a desired shape and placing the diaphragm over the core, or by forming a wire frame of the desired shape and adhering the diaphragm to, or stretching the diaphragm over, the wire frame. By way of example and not limitation, the diaphragm could be a cone, a frustum, a polyhedron, a cylinder with a non-circular horizontal cross section, irregular, or others.

Numerous uses of and departures from the specific apparatus and techniques disclosed herein may be made without departing from the inventive concepts. Consequently, the invention is to be construed as embracing each and every novel feature and novel combination of features disclosed herein and limited only by the spirit and scope of the appended claims.

What is claimed is:

1. An acoustic device comprising:

a passive radiator diaphragm constructed of flexible, acoustically opaque material having an interior pneumatically decoupled from an exterior and substantially enclosing a three dimensional volume; and an acoustic driver radiating pressure waves into the three dimensional volume to cause the diaphragm to expand and contract, radiating acoustic energy; and a core of a porous, compressible material.

2. The acoustic device of claim 1, wherein the core is solid.

3. The acoustic device of claim 1, wherein the core is hollow.

4. The acoustic device of claim 1, wherein the exterior of the core is adhered to the interior surface of the diaphragm.

5. The acoustic device of claim 1, wherein the core is open cell foam.

6. The acoustic device of claim 1, wherein the core is prestressed.

7. The acoustic device of claim 1, wherein the passive radiator diaphragm comprises silicone.

8. The acoustic device of claim 7, wherein the passive radiator diaphragm comprises particles of a dense material that increase the mass of the passive radiator diaphragm.

9. The acoustic device of claim 1, wherein the passive radiator diaphragm comprises particles of a dense material that increase the mass of the passive radiator diaphragm.

10. The acoustic device of claim 1, wherein the three dimensional volume is a sphere.

11. The acoustic device of claim 1, wherein the three dimensional volume is a cylinder.

12. The acoustic device of claim 1, further comprising a first duct pneumatically coupling a radiating surface of the acoustic driver and the interior of the passive radiator diaphragm.

13. The acoustic device of claim 12, further comprising a second duct coupling the acoustic driver or a second acoustic driver and the interior of the passive radiator diaphragm.

14. The acoustic device of claim 12, wherein the duct is pneumatically sealed to the passive radiator diaphragm at two locations.

15. The acoustic device of claim 12, wherein a sealed end of the duct is adhered to the interior of the passive radiator diaphragm.

16. The acoustic device of claim 1, wherein the acoustic driver is mounted to the passive radiator diaphragm.

17. The acoustic device of claim 1, wherein the passive radiator comprises a three dimensional figure comprising plurality of polygon shaped panels joined at edges of the polygon shaped panels.

18. The acoustic device of claim 17, wherein the panels are rigid.

19. The acoustic device of claim 1, wherein the diaphragm comprises a flexible material stretched over a wire frame.

* * * * *